US007143770B1

(12) United States Patent
Keller

(10) Patent No.: US 7,143,770 B1
(45) Date of Patent: Dec. 5, 2006

(54) INJECTION MOLDED ARTIFICIAL FINGERNAILS AND PACKAGING THEREOF

(76) Inventor: Alexander M. L. Keller, 130 Oxford St., Brooklyn, NY (US) 11235

( * ) Notice: Subject to any disclaimer, the term of this patent is extended or adjusted under 35 U.S.C. 154(b) by 406 days.

(21) Appl. No.: 10/635,129

(22) Filed: Aug. 7, 2003

(51) Int. Cl.
*A45D 29/00* (2006.01)

(52) U.S. Cl. ..... 132/73

(58) Field of Classification Search ..... 132/73, 132/73.5; 206/459.5; 40/313
See application file for complete search history.

(56) References Cited

U.S. PATENT DOCUMENTS 3,982,551 A * 9/1976 Bartolucci ..... 132/73
5,251,751 A * 10/1993 Prussen ..... 206/338
5,309,365 A 5/1994 Sullivan et al.
5,450,864 A * 9/1995 LaJoie et al. ..... 132/73
5,813,415 A * 9/1998 Slali ..... 132/73
5,977,205 A 11/1999 Messere et al.
5,988,178 A * 11/1999 Bair ..... 132/73
D441,192 S * 5/2001 Park ..... D3/294
6,516,812 B1 2/2003 Chang
6,742,526 B1 * 6/2004 Riester ..... 132/73

* cited by examiner

*Primary Examiner*—John J. Wilson
*Assistant Examiner*—Robyn Doan
(74) *Attorney, Agent, or Firm*—Myron Amer P.C.

(57) ABSTRACT

The injection molding on a sprue of graduated sizes of artificial fingernails correlated to varying sizes of natural fingernails, in which packaging is according to their position on the sprue and obviates the tedium of measuring.

1 Claim, 2 Drawing Sheets

INJECTION MOLDED ARTIFICIAL FINGERNAILS AND PACKAGING THEREOF

CROSS REFERENCE TO RELATED APPLICATIONS

This application claims the benefit of U.S. Provisional Patent Application No. 60/401,254, filed on Aug. 6, 2002, the contents of which are incorporated herein by reference thereto.

The present invention relates generally to improvements in the packaging of artificial fingernails, the improvements more particularly obviating the tedium of measuring and attending to other handling chores attendant to the varying sizes in which the artificial fingernails have to be provided to correlate to the varying sizes of natural fingernails, all as will be better understood as the description proceeds.

EXAMPLES OF THE PRIOR ART

The injection molding of artificial fingernails is known, as exemplified by U.S. Pat. No. 5,977,205 for "Composition For artificial fingernails" issued to Messere et al. on Nov. 2, 1999 and by U.S. Pat. No. 6,516,812 for "Antibacterial Artificial Fingernail And Method For Production Thereof" issued to Chang on Feb. 11, 2003 to mention but a few.

The application of the artificial fingernail on top of a natural fingernail requires not only the use of an adhesive, but also a correlation of sizes, so that the artificial fingernail is not excessively larger or smaller than the underlying natural fingernail, as would be the case if an artificial fingernail sized to fit over a thumb fingernail was placed on a pinky fingernail.

To avoid such mismatches, the artificial fingernails are packaged in graduated sizes, and include instructions on what size-designated artificial fingernails are recommended for use on identified natural fingernails. The separation into graduated sizes often entails the tedium of measuring the artificial fingernail and, in an effort to obviate this tedious chore, U.S. Pat. No. 5,309,365 for "System For Cutting Artificial Nail Tips And For Decorating The Same Or Existing Nails Using Automated Cutting Processes" issued to Sullivan et al. on May 3, 1994 uses information taken from a sensing device sensing the dimensions of an existing fingernail and inputs this sensed information into a system for cutting to size an artificial fingernail.

In the patents noted, and in all other known patents, there has been a failure to use to advantage the injection molding of the artificial fingernails as a solution to the chore of having to grade the artificial fingernails in their varying required sizes, as a replacement for manually performing this grading or even the automated grading exemplified by the '365 patent.

Broadly, it is an object of the present invention to overcome the foregoing and other shortcomings of the prior art.

More particularly, it is an object to use the varying sizes of the artificial fingernails as produced by injection molding to facilitate their commercial packaging, thereby obviating measuring and substituting instead the location of the molded objects on the injection molding sprue. Stated somewhat differently, the molding cavities are machined in varying sizes, and thus produce correspondingly varying sizes of artificial fingernails, and the packaging by avoiding commingling when detached from the sprue and retaining the size differentiations greatly facilitates the commercial packaging of the product.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
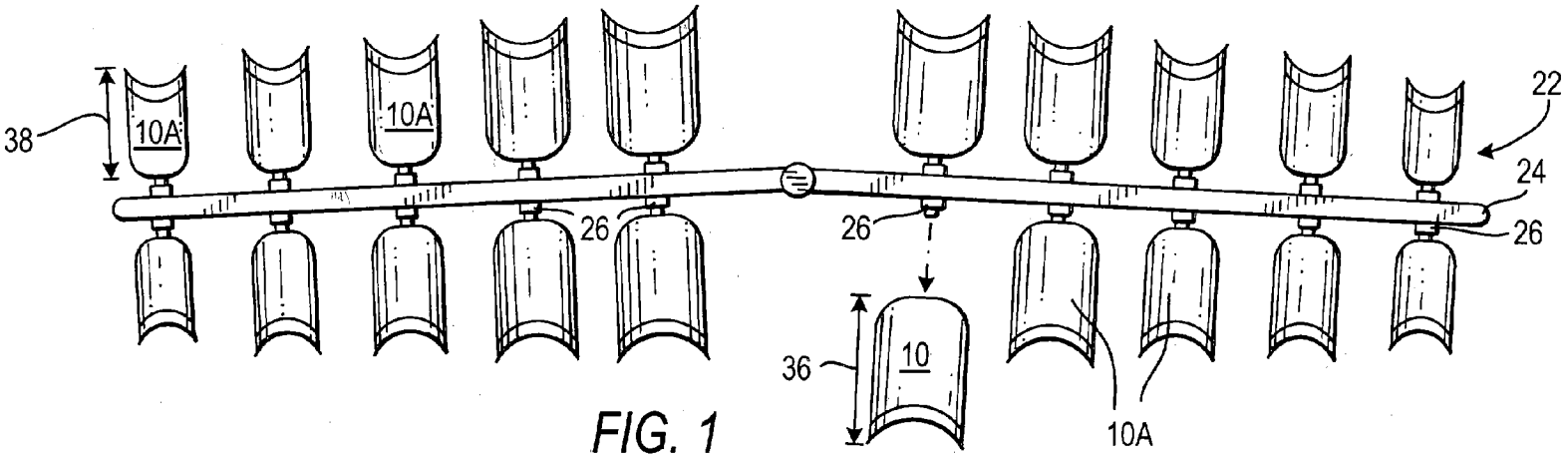
FIG. 1 is a plan view of work-in-process artificial fingernails produced as injection molded articles of manufacture in accordance with the present invention.
Figure 4:
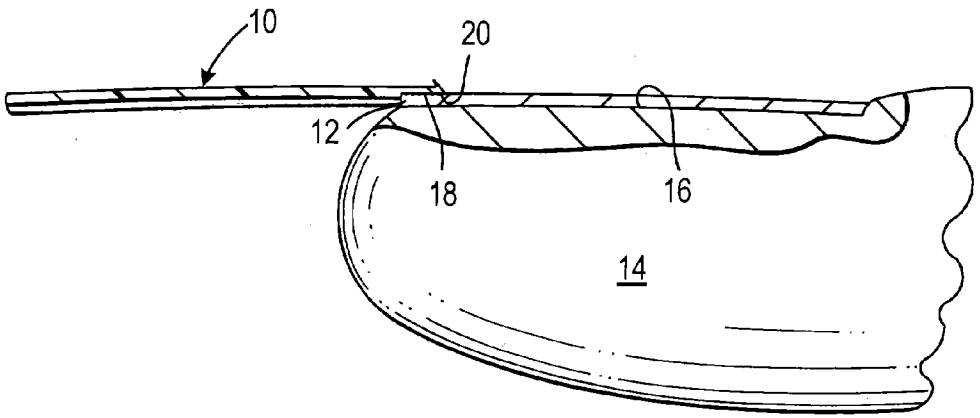
FIG. 4 is a partial side elevational view partly in section of the wearing use of the artificial fingernail.
Figure 3:
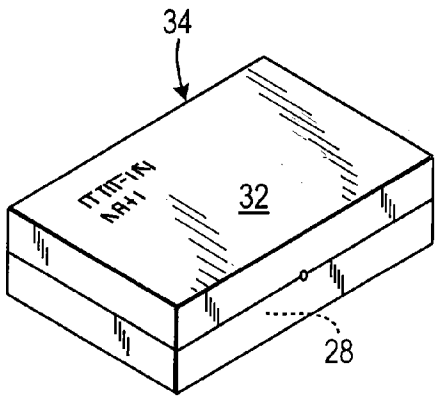
FIG. 3 is a perspective view of the package.

In accordance with a popular fashion trend, it is the practice, primarily by a female to adhesively adhere extensions, individually and collectively designated 10, to natural nails, individually and collectively designated 12, to enhance the appearance of the ends of her fingers 14 which during normal activity are typically always in prominent display as a result of reaching, waiving, gesturing, and like movements.

The activity noted also requires an adequate adhesive attachment of the plastic extensions 10, i.e., artificial fingernails, to the surface 16 of an underlying natural fingernail 12, which is implemented by an adhesive deposit 18 at the interface of the artificial fingernail 10 and natural nail 12. An adhesive which in practice provides satisfactory results obviating inadvertent detachment and/or delamination of the adhesive coating 18 is that commercially available from Chemence of Alphretta, Ga.

The growth of the natural fingernail surface 16 occurs in a slightly curvilinear shape and to contribute to the efficacy of the attachment noted, it is desirable that the artificial fingernail 10 have a conforming curvilinear shape so that there is maximum surface-to-surface bonding of the artificial and natural surfaces 20. 16 on opposite sides of the adhesive deposit 18.

Also, and most important to be noted, the shapes and sizes of the natural fingernails 12 vary on an individual's fingertips, i.e., that on the pinky fingertip being the smallest and on the thumb the largest, and the nails on the fingertips in between in a progressively varying degree.

Underlying the present invention is the recognition that in injection molding of the artificial fingernails 10 a correlation can be advantageously attained between the artificial fingernails thusly molded and the size and shape variation occuring in the growth of natural fingernails. As best understood from FIGS. 1 and 2, the injection molding process produces a so-called tree, generally designated 22, consisting of a sprue 24 having at spaced locations along the sprue 24 connected, as at 26, to progressively sized machined cavities producing from said cavities correspondingly progressively varying shaped and sized work-in-process artificial fingernails 10A. The shape-molding plastic of choice is PVC of pallet designation M48-10 commercially available from PolyOne of Knottingham, Pa., it having been found in practice that the resulting work-in-process artificial fingernails 10A closely retain the shape and size of machined cavities in a steel molding die and exhibit a desirable minimum extent of mold shrinkage while manifesting maximum clarity in appearance, whether molded to be clear or in a selected color of an additive.

Figure 2:
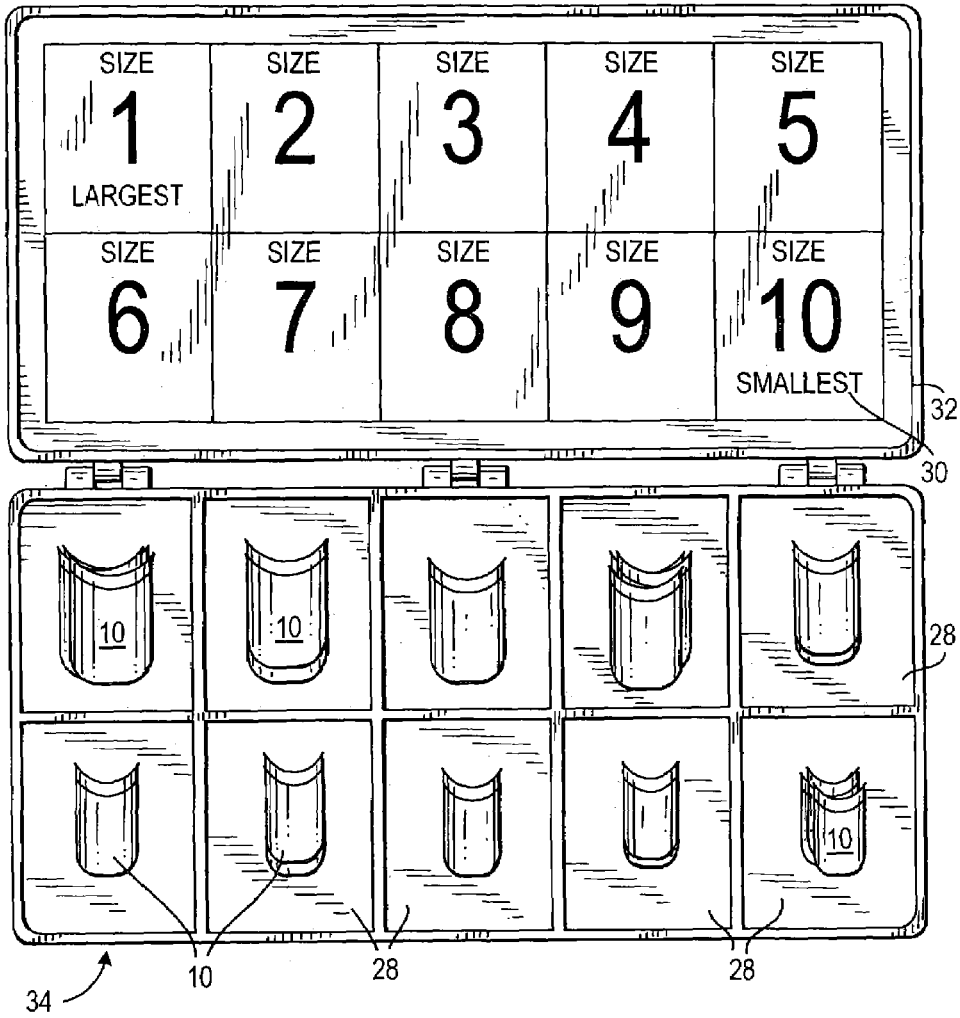
FIG. 2 is a plan view of the sorting of the artificial fingernails of FIG. 1 preparatory to the packaging thereof.

As best understood from FIG. 2, a select number of artificial fingernails 10 detached from the tree 22 are placed in tray compartments 28 correlated to a size chart 30 in the lid 32 of a box container 34 of the product.

For completeness sake, the range of the size variation of the fingernail 10 may be best understood from FIG. 1 in which the largest size 36 may be 1¼ inches, and the smallest size 38 approximately ⅞ inches, the remaining lengths of the injection molded artificial fingernails being progressively smaller by 1/10 the difference therebetween.

In a preferred embodiment in providing bulk quantities of artificial fingernails 10A for use at beauty salons or for packaging at fulfillment houses for mail order and TV-solicited sales, box 34 has two rows of five compartments 28 per row which are correlated by eye to a similar arrangement of the size designations on the chart 30.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of packaging artificial fingernails according to graduated sizes correlated to sizes of natural fingernails comprising the steps of:

A. packaging said artificial fingernails in a rectangular box-like container having a bottom delineated into ten compartments in two parallel rows of five compartments in each row and having a hinged lid thereon;

B. positioning for display in an open condition of said lid a chart imprinted with numerical size designations correlated by corresponding two rows of five imprinted locations in each row to said compartments of said bottom;

C. molding in an injection molding machine to product as a work-in-process a molded tree of polyvinyl chloride construction material characterized in (1) having in said molded tree a sprue;

(2) having in attached adjacent spaced relation along said sprue ten work-in-process artificial fingernails of five in number on one side of said sprue and five in number on the other side of said sprue; and (3) graduated sizes of said ten work-in-process artificial fingernails as determined by said spaced relation along said sprue being of the largest size at a center location on said sprue and the smallest size at a location on an end of said sprue and in graduated sizes therebetween;

D. detaching said work-in-process artificial fingernails from said sprue of said tree; and E. placing in said size-designated compartments said detached artificial fingernails according to said locations thereof on said sprue;

whereby the sizing of said packaged artificial fingernails is facilitated without the tedium of having to be measured.

* * * * *